US009381536B2

(12) United States Patent
Galvin et al.

(10) Patent No.: US 9,381,536 B2
(45) Date of Patent: Jul. 5, 2016

(54) MULTI-BEAD APPLICATOR

(71) Applicant: ADCO Products, LLC, Michigan Center, MI (US)

(72) Inventors: James Galvin, Farmington Hills, MI (US); Paul Snowwhite, Dexter, MI (US); Ronald Vollmer, Chelsea, MI (US)

(73) Assignee: ADCO PRODUCTS, LLC, Michigan Center, MI (US)

( * ) Notice: Subject to any disclaimer, the term of this patent is extended or adjusted under 35 U.S.C. 154(b) by 0 days.

(21) Appl. No.: 13/721,740

(22) Filed: Dec. 20, 2012

(65) Prior Publication Data

US 2013/0168421 A1 Jul. 4, 2013

Related U.S. Application Data

(60) Provisional application No. 61/580,804, filed on Dec. 28, 2011.

(51) Int. Cl.
*B05C 9/06* (2006.01)
*B05C 17/005* (2006.01)
(Continued)

(52) U.S. Cl.
CPC ..... *B05C 9/06* (2013.01); *B05B 13/005* (2013.01); *B05C 17/00589* (2013.01); *E04D 15/07* (2013.01); *B05C 17/00553* (2013.01); *B05C 17/00576* (2013.01)

(58) Field of Classification Search
CPC ..... B05B 9/007; B05B 13/005; B62B 1/00; B62B 1/186; B67D 7/845; B05C 9/06; B05C 17/00589; B05C 17/00553; B05C 17/00576; E04D 15/07
USPC ..... 222/608, 611.1, 626, 386, 326, 327, 222/145.1, 145.5, 145.6; 118/305, 323
See application file for complete search history.

(56) References Cited

U.S. PATENT DOCUMENTS 2,514,441 A * 7/1950 Brown ..... 222/14
2,950,029 A 8/1960 Winstead
(Continued)

FOREIGN PATENT DOCUMENTS

WO WO2011103094 A2 8/2011

OTHER PUBLICATIONS

A.J. Lazarus Associates, Inc., Quick Connect/Disconnect Valve for Precise, Safe Dispensing Offered by Hedwin Corporation, Trade/Newswire, Pearl River, N.Y., Apr. 15, 1987.
(Continued)

*Primary Examiner* — Nicholas J Weiss
(74) *Attorney, Agent, or Firm* — Benesch Friedlander Coplan & Aronoff LLP

(57) ABSTRACT

An apparatus for concurrently applying to a substrate a plurality of substantially parallel strips of an adhesive is provided. The apparatus includes a housing or carrier with motive supports for transporting the carrier along a path of travel over the substrate. A plurality of cradles are mounted on the carrier and are arranged in a line transversely of the path of travel of the carrier over the substrate. Each cradle is adapted to hold a canister of the adhesive. A discharging mechanism is mounted on the carrier and is adapted, when a driving force is applied, to concurrently discharge the adhesive from the plurality of canisters in the cradles. Also mounted on the carrier is an actuating mechanism for selectively providing a driving force to the discharging mechanism. The discharging mechanism may include at least one plunger located at each cradle.

15 Claims, 2 Drawing Sheets

(51) Int. Cl.
*B05B 13/00* (2006.01)
*E04D 15/07* (2006.01)

(56) References Cited

U.S. PATENT DOCUMENTS

| | | | | | |
|---|---|---|---|---|---|
| 3,042,271 | A | | 7/1962 | Winstead | |
| 3,243,084 | A | | 3/1966 | Stegner | |
| 3,353,719 | A | * | 11/1967 | Bruecker | 222/626 |
| 3,599,840 | A | | 8/1971 | Speas | |
| 3,806,002 | A | * | 4/1974 | Mills et al. | 222/626 |
| 3,976,227 | A | * | 8/1976 | Ray | 222/136 |
| 4,535,919 | A | | 8/1985 | Jameson | |
| 4,537,331 | A | * | 8/1985 | Matula | 222/165 |
| 4,545,531 | A | * | 10/1985 | Williams | 239/150 |
| 4,580,701 | A | | 4/1986 | Tamaki | |
| 4,629,094 | A | | 12/1986 | Vogel | |
| 4,789,100 | A | | 12/1988 | Senf | |
| 5,012,956 | A | | 5/1991 | Stoody | |
| 5,033,647 | A | | 7/1991 | Smith et al. | |
| 5,147,062 | A | | 9/1992 | Heuberger et al. | |
| 5,148,988 | A | * | 9/1992 | Smrt | 239/150 |
| 5,254,167 | A | * | 10/1993 | Janoski et al. | 118/108 |
| 5,366,309 | A | * | 11/1994 | Springall | B05C 5/02 118/108 |
| 5,390,825 | A | | 2/1995 | Rockel | |
| 5,494,228 | A | | 2/1996 | Eaton et al. | |
| 5,553,745 | A | | 9/1996 | McMillian | |
| 5,573,066 | A | * | 11/1996 | Vaillancourt et al. | 169/49 |
| 5,573,148 | A | | 11/1996 | Poole et al. | |
| 5,593,091 | A | | 1/1997 | Harris | |
| 5,615,791 | A | | 4/1997 | Vatelot et al. | |
| 5,667,101 | A | | 9/1997 | Barrash et al. | |
| 5,779,109 | A | | 7/1998 | Gueret | |
| 5,810,254 | A | | 9/1998 | Kropfield | |
| 5,826,751 | A | | 10/1998 | Stahley et al. | |
| 5,947,346 | A | * | 9/1999 | London | 222/608 |
| 5,976,631 | A | | 11/1999 | Ramachandran | |
| 5,979,326 | A | | 11/1999 | Ohinata | |
| 6,042,024 | A | | 3/2000 | Gilmore | |
| 6,050,451 | A | | 4/2000 | Hess, III et al. | |
| 6,085,941 | A | | 7/2000 | Pauser et al. | |
| 6,112,955 | A | * | 9/2000 | Lang | 222/626 |
| 6,116,465 | A | | 9/2000 | Bouzaglo | |
| 6,190,366 | B1 | | 2/2001 | Tani | |
| 6,220,526 | B1 | | 4/2001 | Johnson | |
| 6,405,901 | B1 | | 6/2002 | Schantz et al. | |
| 6,422,428 | B1 | | 7/2002 | Allen et al. | |
| 6,679,439 | B2 | | 1/2004 | Duqueroie | |
| 6,688,495 | B2 | | 2/2004 | Masuda | |
| 6,746,109 | B2 | * | 6/2004 | Samuels | 347/85 |
| D501,855 | S | * | 2/2005 | Burns | D15/13 |
| 6,893,000 | B2 | | 5/2005 | Rutter et al. | |
| 6,942,735 | B2 | | 9/2005 | Rich | |
| 6,962,455 | B2 | | 11/2005 | Kugler et al. | |
| 6,968,976 | B2 | | 11/2005 | Masuda | |
| 6,971,548 | B2 | | 12/2005 | Smith | |
| 6,974,053 | B2 | | 12/2005 | Lautre et al. | |
| 7,048,145 | B2 | | 5/2006 | Mitchell | |
| 7,056,556 | B2 | | 6/2006 | Burns | |
| 7,222,751 | B2 | | 5/2007 | Kerman et al. | |
| 7,367,515 | B1 | * | 5/2008 | Newman | 239/150 |
| 7,413,132 | B1 | | 8/2008 | Bogart | |
| 7,626,143 | B2 | | 12/2009 | Miller | |
| 7,757,907 | B2 | | 7/2010 | Smith et al. | |
| 8,113,385 | B2 | | 2/2012 | Choiniere et al. | |
| 8,342,372 | B2 | | 1/2013 | Choiniere et al. | |
| 2003/0047570 | A1 | | 3/2003 | Masuda | |
| 2003/0071059 | A1 | | 4/2003 | Hagihara | |
| 2003/0230596 | A1 | | 12/2003 | Masuda | |
| 2004/0144809 | A1 | | 7/2004 | Kerman et al. | |
| 2004/0256424 | A1 | | 12/2004 | Johnson | |
| 2006/0151526 | A1 | | 7/2006 | Narayanan | |
| 2006/0231572 | A1 | | 10/2006 | Mallet | |
| 2008/0123466 | A1 | | 5/2008 | Thompson et al. | |
| 2011/0259919 | A1 | | 10/2011 | Choiniere et al. | |
| 2012/0181301 | A1 | | 7/2012 | Choiniere et al. | |

OTHER PUBLICATIONS

Lauren R. Hartman, Innovations break through packaging barriers, Dialog(R) File 148: Gale Group Trade & Industry DB(c) 2011 Gale/Cengage, Packaging Digest, v34, n12, p. 44(5), Nov. 1997.
http://web.archive.org/web/20050205101748/http://www.colder.com/asp_Main/BagInBoxProducts.asp, Feb. 5, 2005.
http://web.archive.org/web/20050311204937/http://www.colder.com/asp_Main/FeaturesBenefits/UDCFBInd.asp, Mar. 11, 2005.

* cited by examiner

MULTI-BEAD APPLICATOR

CROSS-REFERENCE TO RELATED APPLICATIONS

This application claims the benefit of U.S. Provisional Application No. 61/580,804 filed Dec. 28, 2011. The disclosure of the above application is incorporated herein by reference.

FIELD

The present invention relates to a multi-bead applicator for dispensing an adhesive on a substrate.

BACKGROUND

There are a number of circumstances where an apparatus for concurrently applying a plurality of strips of an adhesive can be advantageously employed. For example, the construction of roofs for commercial and industrial buildings typically involves, as a first step, installing a corrugated steel decking having alternating peaks, also called ribs, and valleys, also called flutes. Thereafter, one or more layers of an insulating material are placed over the decking. Finally, one or more layers of a waterproof covering or membrane are placed over the insulating material. The membrane may be made of various materials, such as polymeric materials including EPDM (ethylene propylene diene M-rubber), TPO (thermoplastic polyolefin), as well as asphaltic or bitumen based materials.

Conventionally, adhesives are used to secure the various layers of roofing materials to the steel deck to form a unitary covering for the roof. One adhesive composition used to adhere the layers of roofing materials together includes polyurethane. Conventional polyurethane adhesives oftentimes include two separate parts that are mixed by an applicator just prior to being applied onto the surface of the roof deck. The two parts include an isocyanate blend and a simple polyol blend. Upon mixing, the isocyanate blend reacts or crosslinks with the simple polyol blend to form the polyurethane adhesive.

Many roofs may be quite large encompassing many square feet and, in some instances, the roofs may cover several acres. Taking into account the sizes of the roofs that can be involved and the fact that several layers of roofing materials typically are applied, it is highly desirable that an apparatus be available that can rapidly apply large volumes of the polyurethane adhesive to a relatively wide section of a roof, while being easy to operate and control.

SUMMARY

Much of the description and discussion herein relating to the adhesive applicator of the present invention is presented with reference to the use of the invention in connection with the construction of roofs of buildings, particularly where a corrugated steel decking is employed. However, the invention has application, generally, where it is desired to concurrently apply to any type of substrate a plurality of substantially parallel strips or beads of an adhesive, including instances where the adhesive used is the reaction product of two adhesive reactants that are mixed and reacted as the adhesive is applied.

According to one aspect of the present invention an apparatus for concurrently applying to a substrate a plurality of substantially parallel strips or beads of an adhesive is provided. The apparatus includes a housing or carrier with motive supports for transporting the carrier along a path of travel over the substrate. A plurality of cradles are mounted on the carrier and are arranged in a line transversely of the path of travel of the carrier over the substrate. Each cradle is adapted to hold a canister of the adhesive. A discharging mechanism is mounted on the carrier and is adapted, when a driving force is applied, to concurrently discharge the adhesive from the plurality of canisters in the cradles. Also mounted on the carrier is an actuating mechanism for selectively providing a driving force to the discharging mechanism. The discharging mechanism may include at least one plunger located at each cradle that is adapted to fit within the canister of adhesive held in the cradle. Each plunger is connected to the actuating mechanism for displacement within a respective canister so as to discharge the adhesive from the canister concurrently with the discharge of the adhesive from the other canisters upon the actuating mechanism selectively providing a driving force to the discharging mechanism.

According to another aspect, the discharging mechanism includes a pair of plungers located at each cradle. Each pair of plungers is adapted to fit within a complementary pair of segregated compartments that contain adhesive reactants within the canister. The pair of plungers at each cradle is connected to the actuating mechanism for displacement within the pair of segregated compartments in the canister upon the actuating mechanism selectively providing a driving force to the discharging mechanism, including the plungers. The activation of the discharging mechanism results in the discharge of the adhesive reactants from the pair of segregated compartments into a mixing nozzle associated with the canister and from which an adhesive, produced by the mixing and reaction of the two adhesive reactants in the mixing nozzle, is discharged concurrently with the discharge of the adhesive from the other canisters.

According to yet another aspect, the motive supports of the apparatus are configured so that the apparatus can be efficiently employed on a corrugated steel decking having ribs, or peaks, and flutes, or valleys. For example, the motive supports include a pair of coaxial wheels located at the frontward end of the carrier and at least one swivel or caster wheel located at the rearward end of the carrier.

According to yet another aspect, the carrier includes a lift bar for allowing the apparatus to be lifted.

According to yet another aspect, the carrier includes fork slots for allowing a forklift to engage and lift the apparatus.

According to yet another aspect, the apparatus includes markers that extend out from the carrier to assist an operator of the apparatus in maneuvering the apparatus in a straight line.

According to yet another aspect, the apparatus is powered by a battery located in a container easily accessible by an operator of the apparatus.

DRAWING DESCRIPTION

DETAILED DESCRIPTION

The following description is merely exemplary in nature and is not intended to limit the present disclosure, application, or uses.

Figure 1:
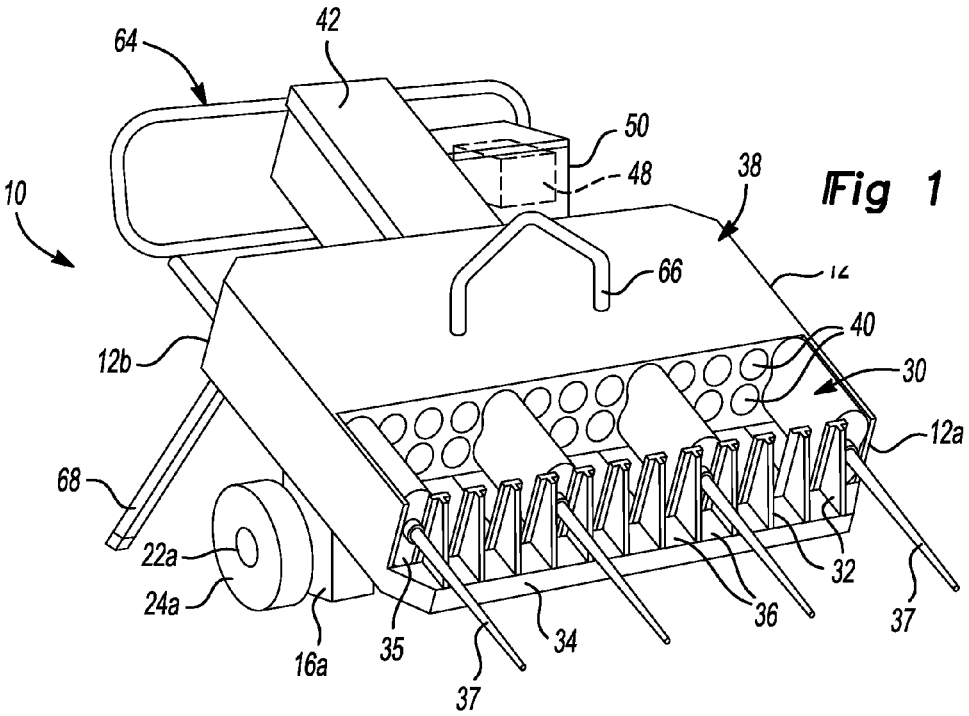
FIG. 1 is a front, perspective view of a device for applying an adhesive.
Figure 2:
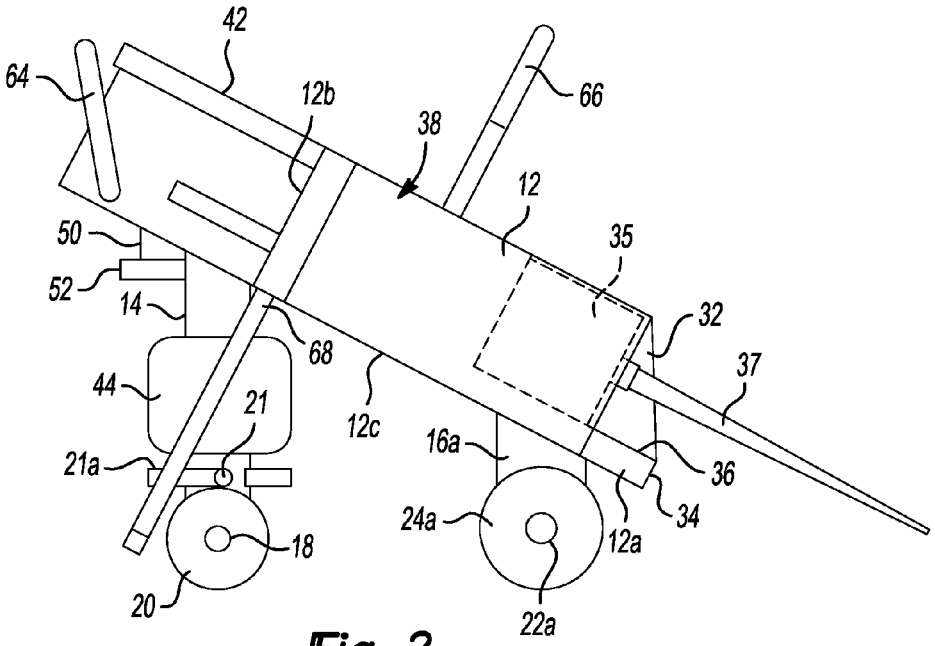
FIG. 2 is a side view of the device.
Figure 3:
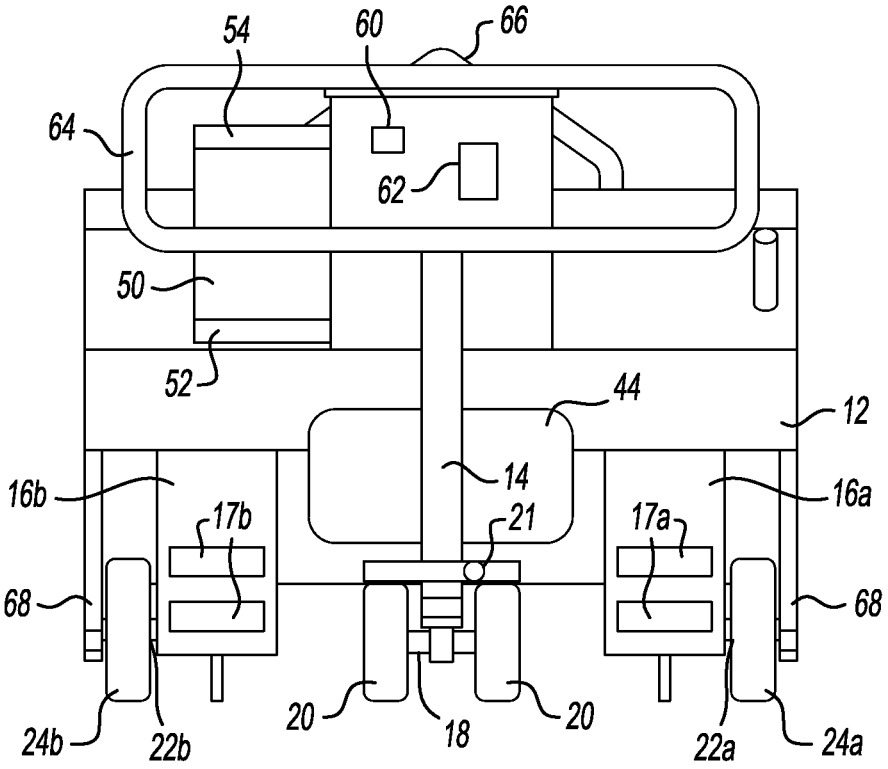
FIG. 3 is rear view of the device.

With reference to FIGS. 1-3, an adhesive applicator is generally indicated by reference number 10. The embodiment of the adhesive applicator 10 illustrated in the drawings comprises an apparatus for concurrently applying to a substrate, such as a roof decking, a plurality of substantially parallel strips or beads of a one-part or two-part adhesive. The adhesive applicator 10 includes a housing or carrier 12. The housing 12 provides a degree of protection to the various components of the applicator 10 as will be described below. A center support member 14 and two side support members 16A and 16B extend downward from a bottom surface of the housing 12. The housing 12 is angled with respect to the support members 14, 16A, and 16B at an angle of less than 90 degrees, and, preferably, at an angle of about 30 degrees, upwardly from a frontward end 12A of the housing 12 toward a rearward end 12B of the housing 12. The center support member 14 is located at the rearward end 12B while the side support members 16A and 16B are located at the frontward end 12A.

The center support member 14 includes a swivel or caster spindle mount 18 for supporting wheels 20. The wheels 20 are pivotable and rotatable allowing the applicator 10 to move forward as well as turn and rotate to greatly improve maneuverability in tight areas. It should be appreciated that one wheel 20 or more than two wheels 20 may be employed without departing from the scope of the present invention. In addition, a locking mechanism 21, best seen in FIGS. 2 and 3, may be incorporated with the caster spindle mount 18 to lock the caster in place to aid in proper bead placement when dispensing adhesive. The swivel aspect of the caster may be "unlocked" via a handle 21A to aid in maneuvering in tight areas. Each of the side support members include a spindle 22A and 22B each for supporting at least one wheel 24A and 24B, respectively. Each side support member 16A and 16B also includes fork pockets or slots 17A and 17B, respectively located therein and sized to receive the forks of a forklift to allow the applicator 10 to be easily lifted and transported by a conventional forklift. The fork slots 17A and 17B preferably open in a direction towards the rearward end 12B of the housing 12.

In operation, the applicator 10, as illustrated in FIG. 2, follows a path of travel from the right to the left and the wheels 24A and 24B, located at the frontward end of the housing 12, and the spindle wheel 20, located at the rearward end of the housing 12, provide motive supports for transporting the applicator 10 over the substrate onto which the adhesive is to be applied.

The spacing and arrangement of the wheels 20, 24A, and 24B shown in the drawings enables the applicator 10 to easily traverse a corrugated steel decking, such as a "B" type deck, in a roofing system. Corrugated steel deckings are fabricated so as to have alternating ribs, or peaks, and flutes, or valleys. Accordingly, the embodiment of the adhesive applicator 10 shown in the drawings is constructed so that the pair of wheels 24A and 24B are located coaxially at the frontward end 12A of the housing 12 and are spaced apart a distance such that the wheels 24A and 24B rest at the top of flutes in the decking. Additionally, the wheels 24A and 24B are of a width such that they will easily fit atop the flutes. The two wheels 20 are located coaxially at the rearward end 12B of the housing 12 inwardly of the wheels 24A and 24B. The width of each wheel 20 is lesser than the width of the flutes in the corrugated decking and, consequently, the wheels 20 rest at the bottoms of the ribs of the decking when the applicator 10 is traversing the decking with the rearward end 12B of the housing 12 leading the forward end 12A. With this arrangement of the wheels, the wheels 20 serve to keep the applicator 10 on a straight course as the corrugated steel decking is traversed and the adhesive applied.

Mounted to the housing 12 is a rack of a plurality of cradles shown generally at 30. The rack of cradles 30 extends, generally, transversely to the path of travel of the applicator 10 over the substrate to which the adhesive is to be applied. The rack of cradles 30 includes a plurality of cradle bars 32 and a resting plate 34. Each of adjacent pairs of the cradle bars 32 defines a cradle or space for holding a canister 35 of the adhesive as shown by the dashed lines in FIGS. 1-3. In the example provided, the applicator 10 is configured to hold up to thirteen canisters 35 at any one time. The plurality of cradle bars 32 are attached to the housing 12 parallel to one another and spaced apart a preselected distance and extend across the housing 12 in a direction transversely of the path of travel of the applicator 10. Notches 36 are provided in the top edge of resting plate 34 at locations substantially equidistant between the points where each pair of cradle bars 32 is attached to the resting plate 34 as best shown in FIG. 1. The notches 36 are sized to receive a mixing and dispensing nozzle 37 attachable to the canister 35.

The spacing between adjacent cradles is coordinated with the spacing of the ribs in the corrugated roof decking to which the adhesive is to be applied so that the mixing and dispensing nozzle 37 of each adhesive canister 35 will be disposed at a rib in the roof decking. By way of example, a standard roof decking has ribs spaced on centers every 6 inches. In that case, the notches 36 in the resting plate 34 are spaced apart by 12 inches so that the nozzles 37 of the canisters 35 will be located above every second rib in the roof decking. It should be appreciated that various other spacing configurations may be employed without departing from the scope of the present invention.

Also mounted to the housing 12 is a discharging mechanism 38 that is adapted, when activated, to discharge or displace the adhesive from the canisters 35. The discharging mechanism 38 generally includes a series of plungers of substantially equal length, indicated generally at 40. The plungers 40 are positioned so as to be arranged in pairs of plungers 40, and there are the same number of pairs of plungers 40 as cradles. The pairs of plungers 40 are positioned so that the plungers 40 of each pair of plungers 40 are contained within a respective cradle and fit snugly within segregated cylindrical compartments in the canisters 35. A pair of plungers 40 is employed with the canister 35 in each cradle in order to effectively discharge both adhesive reactants of the two-part adhesive that is employed with the adhesive applicator 10 shown in the figures. An example of a discharging mechanism is shown in commonly assigned U.S. Pat. No. 7,056,556 B2, herein incorporated by reference. It is preferred for a variety of applications to employ an adhesive that is the reaction product of two adhesive reactants such as a diisocyanate and a polyol mixture. The reactants must be separated until the adhesive is applied to the substrate because the adhesive formed when the reactants are mixed together will cure and set up soon after the reactants are mixed. This separation is accomplished in the present invention by packaging the adhesive reactants in segregated compartments in the canisters 35. At the time the adhesive is to be applied, the adhesive reactants are displaced from their respective compartments into nozzles 37 by the plungers 40 where the reactants mix and react to form an adhesive that is then discharged from the nozzles to the substrate. Although it is presently preferred to use the applicator with two-part adhesives, in which case two plungers 40 are required for each adhesive canister 35, it will be apparent to one of ordinary skill in the art that the applicator 10 of the invention can be modified for use with single-component adhesives.

The applicator 10 also includes an actuating mechanism 42 mounted on the housing 12 for activating the discharging mechanism 38. The actuating mechanism 42 includes a driving device 44, such as an electric motor, for developing a driving force. The driving device 44 is attached to the center support member 14. The driving device 44, when energized, actuates the discharging mechanism 38 and drives the plungers 40 through the segregated compartments of the canisters 35, thereby displacing the adhesive reactants from the compartments into the nozzles 37 where the reactants mix and react to form the adhesive that is then discharged and applied to the substrate. Of course, it is not necessary that an electric motor be used as the actuating mechanism to force the movement of the plungers 40 and any suitable mechanism can be used. For example, an air compressor can be used in place of the electric motor and a rack and pinion gearing arrangement can be used in place of a telescoping member. Other mechanisms for delivering a driving force also can be used as will be apparent to one of ordinary skill in the art based on the disclosures contained herein.

The energy source for operating the driving device 44 is a battery 48 located in a box 50. The box 50 is supported by a tray 52 coupled to the center support member 14. The box 50 includes a pivoting lid 54 that allows access to the battery 48. The lid 54 is oriented such that the lid 54 pivots about an imaginary line that extends through the imaginary planes of the front and rear ends 12A and 12B of the housing 12. The orientation of the lid 54 allows for easy access to the battery 48 within the box 50.

A trigger switch 60 is mounted on the outside of the actuating mechanism 42 and is electrically interposed between the battery 48 and the driving device 44 so as to control the delivery of electric energy to the driving device 44 and selectively energize the driving device 44 and activate the discharging mechanism 38. In addition, a speed dial 62 located on the actuating mechanism 42 allows adjustable-speed operation of the driving device 44.

For the purpose of maneuvering the applicator, a substantially rectangular-shaped handle 64 is provided at the forward end 12B of the applicator 10. For purpose of lifting the applicator 10 using a crane or other device, a lift bar 66 is attached to a top surface of the housing 12. The applicator 10 also includes markers 68 that extend out from a bottom surface 12C of the housing 12. The markers 68 are each located at the rearward end 12B of the housing 12 on opposite sides thereof. The markers 68 extend downwards perpendicular to the bottom surface 12C such that the markers 68 are visible by an operator of the applicator 10 standing at the rearward end 12B and holding the handle 64. The markers 68 are preferably straight and flexible. The markers 68 allow an operator of the applicator 10 to align the markers 68 with linear features on the substrate in order to maintain a straight movement during operation of the applicator 10.

In operation on a corrugated steel decking, the applicator 10 is positioned on the decking so that the two wheels 20 straddle a rib in the decking and rest at the bottoms of two adjacent flutes in the decking and the two wheels 24A and 24B rest at the tops of the decking ribs or alternatively in the flutes. At the same time, the nozzle 37 of each canister 35 will be disposed slightly above a rib onto which it is desired to apply a bead of adhesive. Operation of the applicator 10 is selectively performed by the operator engaging the trigger switch 60 and pulling the applicator 10 as the operator walks backwards using the handle 64. Upon the engagement of the trigger switch 60 by the operator, the driving device 44 will develop a driving force that will extend the plungers 40 and will force the closure caps in the segregated compartments of the canisters 35 through the compartments, thereby displacing the adhesive reactants from the segregated compartments into the nozzles 37 of the canisters 35. The adhesive reactants will mix and react inside the nozzles 37 and the reaction product, an adhesive, will be discharged from the nozzles onto the substrate. The speed at which the operator moves the applicator 10 over the decking will determine the thickness of the strips or beads of adhesive that are applied.

The foregoing description of a particular embodiment of the invention discloses the use of the same number of adhesive canisters as strips or beads of adhesive to be applied to the substrate. However, alternative arrangements can be employed. Thus, there can be provided at least one respective plunger for each of one or more canisters. The at least one respective plunger is connected to the actuating mechanism for displacement within each canister upon the application of a driving force from the actuating mechanism, whereby the adhesive from the one or more canisters is displaced to the substrate as a plurality of substantially parallel strips or beads of the adhesive. As an example of the foregoing, where a two-component adhesive is to be applied, one of the components, or reactants, can be contained within a first canister and the other of the components, or reactants, can be contained within a second container. The reactants can be displaced from the first and second canisters using plungers, generally, in the manner described above. The displaced reactants can be directed through suitable conduits to a mixing device on the carrier where the reactants mix and react to from the adhesive. The adhesive can then be directed through a plurality of suitable conduits on the carrier and a plurality of substantially parallel strips or beads of the adhesive concurrently applied to the substrate. Alternatively, the reactants can be directed separately from the canisters through conduits on the carrier to a plurality of mixing devices and the resulting adhesive formed at each mixing device concurrently applied to the substrate.

The description of the invention is merely exemplary in nature and variations that do not depart from the gist of the invention are intended to be within the scope of the invention. Such variations are not to be regarded as a departure from the spirit and scope of the invention.

The following is claimed:

1. An apparatus for applying an adhesive onto a substrate where the adhesive is stored within a plurality of canisters, the apparatus comprising:

a carrier having a front end and a back end, wherein the front end and the back end are perpendicular to a path of travel of the carrier;

a first, second, and third support member each connected to the carrier, wherein the second and third support members each include a fork slot for allowing a forklift to engage and lift the apparatus;

a first and second marker attached to the back end of the carrier on opposite sides thereof, wherein each marker, which is substantially straight and extends perpendicularly from a bottom surface of the back end of the carrier, allow an operator to align each marker with a linear feature on the substrate;

a plurality of cradles connected to the carrier at the front end, wherein the plurality of cradles are arranged in a line transversely to the path of travel of the carrier, and wherein each of the plurality of cradles is adapted to receive one of the plurality of canisters of adhesive; and a discharge mechanism connected to the carrier, the discharge mechanism operable to concurrently contact the plurality of canisters of adhesive within the plurality of cradles to discharge the adhesive from the plurality of canisters onto the substrate.

2. The apparatus of claim 1 wherein the first support member is located proximate the rear end of the carrier and the second and third support members are located proximate the front end of the carrier.

3. The apparatus of claim 2 wherein the second and third support members each include a coaxial wheel and the first support member includes two caster wheels.

4. The apparatus of claim 3 wherein the caster wheels are spaced apart to fit within parallel, spaced apart valleys disposed on the substrate where the substrate is a corrugated type B steel deck.

5. The apparatus of claim 1 wherein the discharge mechanism is driven by an electric motor attached to one of the carrier, the first support member, the second support member, and the third support member.

6. The apparatus of claim 5 further comprising a battery disposed on a tray connected proximate the back end of the carrier.

7. The apparatus of claim 1 wherein the discharge mechanism includes at least one plunger located at each cradle that is adapted to fit within the canister of adhesive within the cradle, and wherein each plunger is displaced within a respective canister so as to concurrently discharge the adhesive from the plurality of canisters upon the electric motor selectively providing a driving force to the discharging mechanism.

8. The apparatus of claim 7 wherein the discharge mechanism includes two plungers located at each cradle and wherein each of the two plungers at each cradle is adapted to fit within a complementary pair of segregated compartments of the canister that contain adhesive reactants within the canister.

9. The apparatus of claim 1 further comprising a lift bar connected to the carrier.

10. An apparatus for applying an adhesive onto a substrate where the adhesive is stored within a plurality of canisters, the apparatus comprising:

a carrier having a bottom surface facing the substrate, a front end and a back end, wherein the front end and the back end are perpendicular to a path of travel of the carrier;

a first, second, and third support member each connected to the carrier, wherein the first support member is located proximate the back end of the carrier and the second and third support members are located proximate the front end of the carrier, and wherein the second and third support members each include a coaxial wheel and the first support member includes at least one caster wheel; and wherein the second and third support members each include a fork slot for allowing a forklift to engage and lift the apparatus, a marker connected to the back end of the carrier on opposite sides thereof, wherein the marker, which is substantially straight and extends perpendicularly from the bottom surface of the carrier facing the substrate, allows an operator to align the marker with a linear feature on the substrate;

a plurality of cradles connected to the carrier at the front end, wherein the plurality of cradles are arranged in a line transversely to the path of travel of the carrier, and wherein each of the plurality of cradles is adapted to receive one of the plurality of canisters of adhesive; and a discharge mechanism connected to the carrier, wherein the discharge mechanism is driven by an electric motor attached to one of the carrier, the first support member, the second support member, and the third support member and the discharge mechanism operable to concurrently contact the plurality of canisters of adhesive within the plurality of cradles to discharge the adhesive from the plurality of canisters onto the substrate.

11. The apparatus of claim 10 wherein the first member includes two caster wheels that are spaced apart to fit within parallel, adjacent, spaced apart valleys disposed on the substrate where the substrate is a corrugated steel deck.

12. The apparatus of claim 10 further comprising a battery disposed on a tray connected proximate the back end of the carrier.

13. The apparatus of claim 12 wherein the discharge mechanism includes at least one plunger located at each cradle that is adapted to fit within the canister of adhesive within the cradle, and wherein each plunger is displaced within a respective canister so as to concurrently discharge the adhesive from the plurality of canisters upon the electric motor selectively providing a driving force to the discharging mechanism.

14. The apparatus of claim 13 wherein the discharge mechanism includes two plungers located at each cradle and wherein each of the two plungers at each cradle is adapted to fit within a complementary pair of segregated compartments of the canister that contain adhesive reactants within the canister.

15. The apparatus of claim 14 further comprising a lift bar connected to the carrier.

* * * * *